US005372526A

United States Patent [19]

Ozawa et al.

[11] Patent Number: 5,372,526

[45] Date of Patent: Dec. 13, 1994

[54] DRIVE BEARING LUBRICATING DEVICE FOR WATER INJECTION PROPULSION VESSEL

[75] Inventors: Shigeyuki Ozawa; Ryoichi Nakase, both of Hamamatsu, Japan

[73] Assignee: Sanshin Kogyo Kabushiki Kaisha, Hamamatsu, Japan

[21] Appl. No.: 101,397

[22] Filed: Aug. 2, 1993

[30] Foreign Application Priority Data

Jul. 31, 1992 [JP] Japan ..... 4-223630

[51] Int. Cl.[5] ..... B63H 11/00

[52] U.S. Cl. ..... 440/38; 440/112

[58] Field of Search ..... 440/49, 53, 112, 38; 114/270

[56] References Cited

U.S. PATENT DOCUMENTS

| | | | |
|---|---|---|---|
| 3,625,523 | 12/1971 | Gardner | 440/112 |
| 4,395,141 | 7/1983 | Peitsch et al. | 440/112 |
| 4,632,403 | 12/1986 | Ishitani et al. | 440/112 |
| 4,872,531 | 10/1989 | Meisenburg et al. | 440/112 |
| 5,152,704 | 10/1992 | Carlson | 440/112 |
| 5,209,497 | 5/1993 | Von Bergen et al. | 440/112 |

FOREIGN PATENT DOCUMENTS 319797 3/1979 Japan .

*Primary Examiner*—David M. Mitchell
*Assistant Examiner*—Stephen P. Avila
*Attorney, Agent, or Firm*—Knobbe, Martens, Olson & Bear

[57] ABSTRACT

Two embodiments of water jet propulsion units having an improved bearing arrangement for supporting the impeller shaft where it passes through the hull for connection to the engine. In each embodiment, a gravity feed oil system supplies lubricant to the bearing.

5 Claims, 3 Drawing Sheets

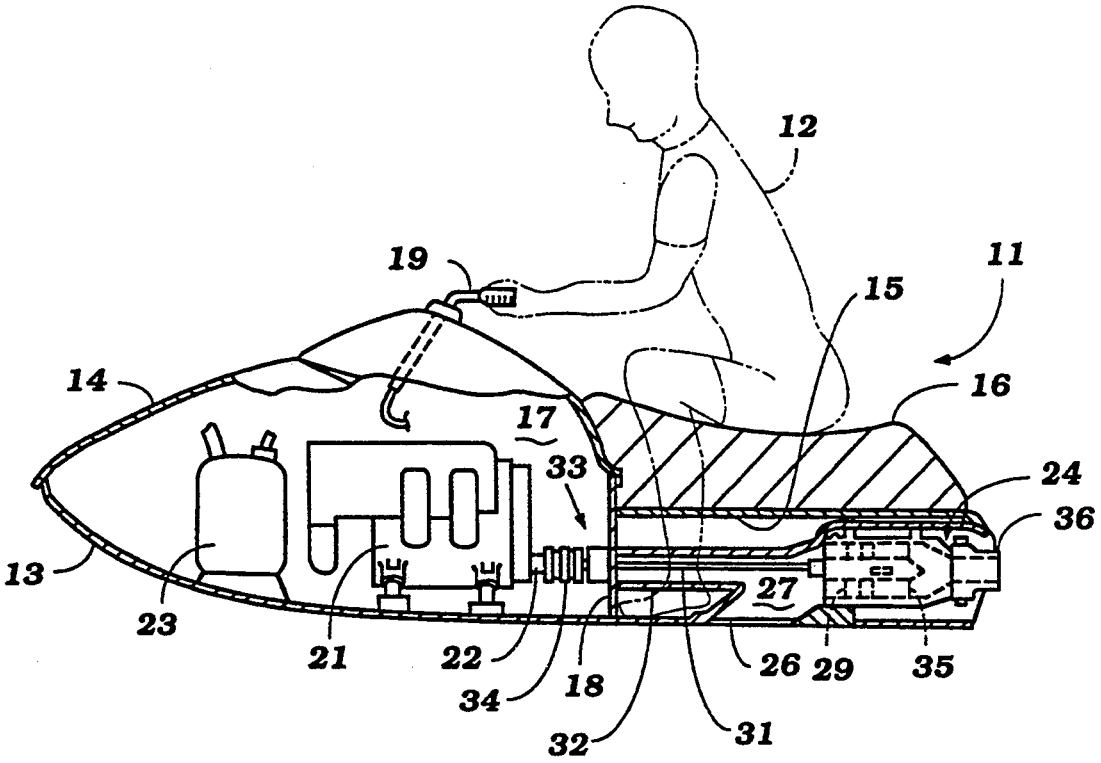
Figure 2
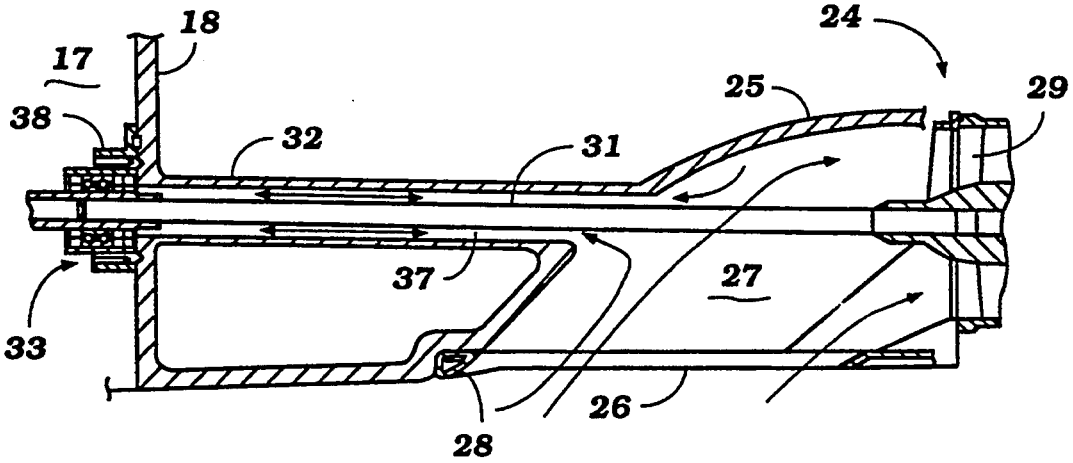

DRIVE BEARING LUBRICATING DEVICE FOR WATER INJECTION PROPULSION VESSEL

BACKGROUND OF THE INVENTION

This invention relates to a drive bearing lubrication device for a water injection propulsion vessel and more particularly to an improved front bearing support and lubrication arrangement for a water jet propulsion unit.

A wide variety of water vessels are propelled by jet propulsion units. These jet propulsion units include an impeller that is driven by an impeller shaft which extends forwardly through a bulkhead in the hull of the watercraft for driving connection to an internal combustion engine positioned within the hull. The place where the impeller shaft passes through the bulkhead normally is provided with an intermediate bearing that journals the impeller shaft. Of course, it is desirable to ensure that this intermediate bearing is lubricated.

Conventionally, arrangements have been provided wherein the intermediate bearing is a prepacked, sealed bearing or, alternatively, where the bearing is provided with a grease fitting so that it can be periodically lubricated. Both of these types of construction present some difficulties.

For example, if a sealed bearing is employed it must be ensured that the lubricant is quite thick so that it will not leak out and need repacking at frequent intervals. However, the thicker the lubricant, the less likely that the bearing will be adequately lubricated. Alternatively, if a grease fitting is employed, then this requires periodic maintenance by the operator including stopping of the engine and the provision of a grease gun to pressurize the bearing. Both of these expedients are not particularly advantageous.

It is, therefore, a principal object of this invention to provide an improved arrangement for lubricating the bearing of a water jet propulsion unit.

It is a further object of this invention to provide an improved lubricating system for the intermediate bearing of a jet propulsion drive for a watercraft.

SUMMARY OF THE INVENTION

This invention is adapted to be embodied in a water jet propulsion unit having an impeller shaft that extends through the jet propulsion housing and is drivably coupled to an engine. An intermediate bearing is provided for supporting the impeller shaft. In accordance with the invention, a supply of lubricating oil is provided and is connected to the intermediate bearing through a conduit for continuously supplying lubricant to the bearing.

BRIEF DESCRIPTION OF THE DRAWINGS

FIG. 1 is a side elevational view of a small watercraft having a jet propulsion unit constructed in accordance with an embodiment of the invention, with portions broken away and shown in section.

FIG. 2 is an enlarged cross-sectional view showing the forward portion of the jet propulsion unit.

DETAILED DESCRIPTION OF THE PREFERRED EMBODIMENTS OF THE INVENTION

Figure 3:
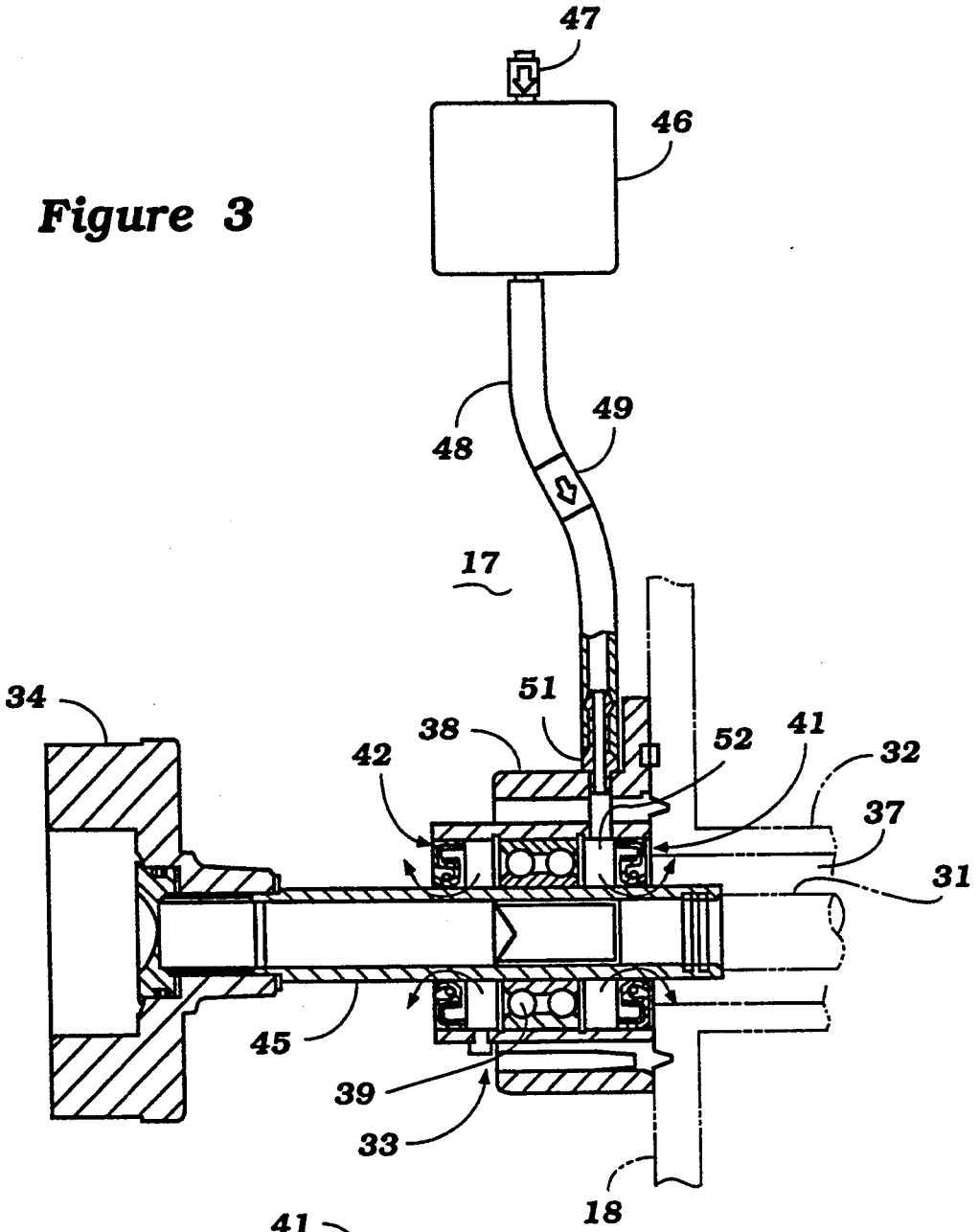
FIG. 3 is a still further enlarged cross-sectional view showing the lubrication system of this embodiment.

Referring first to FIG. 1 for orientation purposes, a small watercraft powered by a jet propulsion unit of the type embodying the invention is identified generally by the reference numeral 11. In the illustrated embodiment, the watercraft 11 is of a type designed to be operated by a single rider seated in straddle fashion as indicated in phantom at 12. It is to be understood, however, that the invention is capable of being used in a wide variety of different types of jet propelled watercraft.

The watercraft 11 is comprised of a hull consisting of a lower hull portion 13 and upper deck portion 14 which are formed from a molded fiberglass reinforced resinous plastic or the like.

A tunnel 15 is formed centrally at the rear of the hull portion 13 and is overlaid by a seat 16 that accommodates the rider 12. An engine compartment 17 is formed forwardly of the tunnel 15 and is separated therefrom by a bulkhead 18. A controlling handlebar assembly 19 is provided forwardly of the rider's seat 16 for control of the watercraft in a manner which will be described.

The engine compartment 17 contains an internal combustion engine, indicated by the reference numeral 21, and which may be of any known type. The engine 21 drives an output shaft 22 that extends rearwardly toward the bulkhead 18 and tunnel 15. Various auxiliaries for the engine 21 are also supported in the engine compartment 17, such as a fuel tank 23.

A jet propulsion unit, indicated generally by the reference numeral 24 is positioned within the tunnel 15 and is driven by the engine 21 in a manner which will be described for powering the watercraft 11. The jet propulsion unit 24 is provided with an outer housing 25 that defines a downwardly facing water inlet opening 26 that communicates with a water inlet duct 27 formed in the housing 25. A screen 28 is positioned across the inlet opening 26 to exclude the entry of large foreign objects into the jet propulsion unit.

An impeller 29 is positioned within the housing 25 and is fixed to an impeller shaft 31. The impeller shaft 31 extends forwardly through a tubular extension 32 of the housing 25 and is supported at its forward end by a bearing arrangement, indicated generally by the reference numeral 33, and which has a construction and lubrication system which will be described in more detail by reference to FIGS. 3 and 4. A coupling 34 couples the forward end of the impeller shaft 31 to the engine output shaft 22 for driving the impeller 29 and drawing water through the water inlet duct 27 as shown by the arrows in FIG. 2.

This water is then driven rearwardly by the impeller 29 past a plurality of straightening vanes 35 to a pivotally supported discharge and steering nozzle 36 from whence the water is discharged back into the body of water in which the watercraft is operating. The steering nozzle 36 is coupled in a known manner to the handlebar assembly 19 so as to afford steering control for the watercraft 11 in a well known manner.

The construction as thus far described may be considered to be conventional, except for the bearing 33. It should be noted further, however, that the tubular extension 32 of the jet propulsion unit housing 25 is spaced outwardly of the impeller shaft 31 so as to define a void or cavity 37 through which water under pressure may pass forwardly toward the bearing assembly 33 for a purpose which will be described.

The bearing assembly 33 and its lubrication system will now be described by particular reference to FIGS. 3 and 4. As may be seen, a bearing support assembly 38 is affixed to the front wall of the bulkhead 18 in the engine compartment 17. The bearing housing 38 has an inner sleeve that supports a ball type antifriction bearing 39. A pair of lip type oil seals 41 and 42 are positioned at the opposite ends of the sleeve outside of the bearing 39 with the rear seal being in communication with the cavity 37 around the impeller shaft 31 in which water is retained. The seal 41 separates the engine compartment 17 from the bearing 39.

Figure 4:
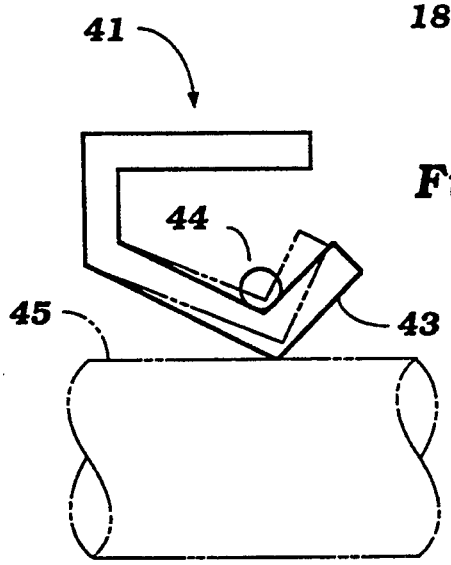
FIG. 4 is a still further enlarged cross-sectional view showing the seal arrangement.

As may be seen in FIG. 4, the lip type seal 41 includes a lip portion 43 that is normally biased by means of a spring 44 into sealing engagement with an extension piece 45 that is fixed for rotation with the impeller shaft 31. In addition, the water pressure in the chamber 37 will further assist in the sealing operation.

An oil tank 46 is positioned vertically above the bearing plate 38 and has a fill cap 47 which incorporates a check valve that will permit air to enter the tank 48 as lubricant is consumed but which will preclude flow in the reverse direction. A conduit 48 in which a further one-way check valve 49 is positioned connects the oil tank 46 with a lubricant nipple 51 formed in the bearing housing 38 and which communicates with a cavity 52 formed between the seal 41 and the bearing 39. By using oil rather than grease, the oil may easily flow through the bearing 39 and be retained by the seal 42 at the opposite end. As a result, if any lubricant escapes as shown by the arrows in FIG. 3, it will be readily replaced from the tank 46 and periodic lubrication is not required. All that is required is a periodic inspection of the lubricant in the tank 46 and refilling of it through the fill neck 47.

Figure 5:
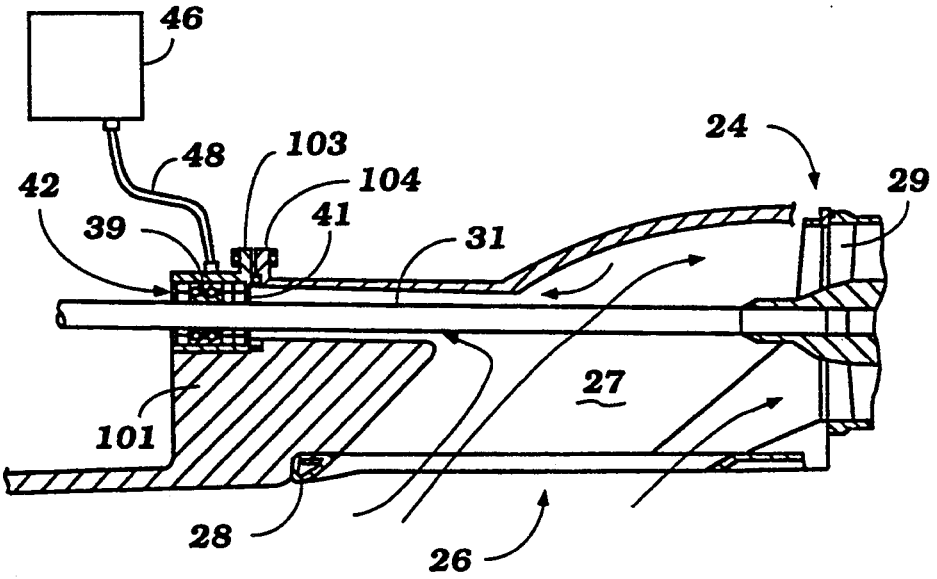
FIG. 5 is a cross-sectional view, in part similar to FIGS. 2 and 3, and shows another embodiment of the invention.

FIG. 5 shows another embodiment of the invention which is similar to the embodiment of FIGS. 1–4 but in this embodiment the bulkhead arrangement is slightly different, as will be described. Because this is the only difference from the previously described embodiment, components which are the same or substantially the same have been identified by the same reference numerals and will not be described again, except insofar as is necessary to understand the construction and operation of this embodiment.

In this embodiment, the hull is provided with a portion which provides not only the bulkhead but also a portion of the water inlet duct, this hull portion being indicated generally by the reference numeral 101. The impeller shaft 31 extends through an opening in the wall 101 that is defined in part by a recess 102 that is closed by means of a closure plate 103 with an O-ring seal 104 providing a water seal in this area. Like the embodiment of the previous embodiment, oil seals 41 and 42 are provided on opposite sides of a bearing 39 that is retained in the closure plate 103. An oil tank 46 is provided above the bearing 39 and supplies lubricant to the bearing 39 through a conduit 48. Like the previously described embodiment, a check valve may be provided in the fill neck for the tank 46 so as to permit air to flow into the tank as lubricant is consumed, but precludes flow in the reverse direction and a check valve may be provided in the conduit 48.

It should be readily apparent from the previous description that the embodiments of the invention provide a good bearing support for a marine jet propulsion unit and effective lubrication therefor with minimum service intervals. Of course, the foregoing description is that of preferred embodiments of the invention and various changes and modifications may be made without departing from the spirit and scope of the invention as defined by the appended claims.

We claim:

1. A jet propulsion unit for a watercraft having a hull defining a tunnel at the rear of its underside with a bulkhead at the forward end of said tunnel, said jet propulsion unit comprising an outer housing rotatably journaling an impeller, a water inlet duct formed forwardly of said impeller by said outer housing and extending rearwardly from a downwardly facing water inlet opening to said impeller, an impeller shaft affixed to said impeller and extending forwardly through said water inlet duct and a tubular portion of said housing which extends forwardly from said water inlet opening and to said bulkhead, an anti-friction bearing rotatably journaling said impeller shaft at a forward position on the hull side of said bulkhead where an engine is drivingly coupled to said impeller shaft, seal means disposed on opposite sides of said bearing, a lubricant tank forwardly of said bulkhead, and conduit means for delivering lubricant from said lubricant tank to said bearing.

2. A jet propulsion unit as set forth in claim 1 wherein the lubricant tank is positioned vertically above the bearing for delivering lubricant thereto by gravity.

3. A jet propulsion unit as set forth in claim 2 further including check valve means in said lubricant conduit for permitting flow of lubricant from said tank to said bearing but precluding flow in the opposite direction.

4. A jet propulsion unit as set forth in claim 1 wherein water from the water inlet duct surrounds the impeller shaft within the tubular portion.

5. A jet propulsion unit as set forth in claim 4 wherein the seals are lip type seals and the water pressure in the housing tubular portion effects increased sealing pressure of the lip type seal separating the bearing from the tubular portion.

* * * * *